US006718297B1

(12) United States Patent
Pride, III et al.

(10) Patent No.: US 6,718,297 B1
(45) Date of Patent: Apr. 6, 2004

(54) APPARATUS AND METHOD FOR DISCRIMINATING BETWEEN VOICE AND DATA BY USING A FREQUENCY ESTIMATE REPRESENTING BOTH A CENTRAL FREQUENCY AND AN ENERGY OF AN INPUT SIGNAL

(75) Inventors: Joseph Peebles Pride, III, Elk Grove, CA (US); Edward James Carroll, Sunnyvale, CA (US); Cheryl Jean Franklin, Yorba Linda, CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/504,784

(22) Filed: Feb. 15, 2000

(51) Int. Cl.[7] ..... G10L 11/00
(52) U.S. Cl. ..... 704/206; 379/93.09
(58) Field of Search ..... 704/206, 205, 704/201, 203; 379/93.09, 93.01, 93.06

(56) References Cited

U.S. PATENT DOCUMENTS 4,281,218 A 7/1981 Chuang et al.
4,314,100 A * 2/1982 Ruether et al. ..... 704/231
4,442,540 A 4/1984 Allen
5,025,443 A 6/1991 Gupta
5,267,301 A 11/1993 Nishii
5,315,704 A 5/1994 Shinta et al.
5,323,337 A * 6/1994 Wilson et al. ..... 702/73
5,615,297 A 3/1997 Davis
5,694,517 A 12/1997 Sugino et al.
5,778,024 A 7/1998 McDonough

* cited by examiner

*Primary Examiner*—Richemond Dorvil
*Assistant Examiner*—Donald L. Storm
(74) *Attorney, Agent, or Firm*—Alston & Bird LLP

(57) ABSTRACT

The present invention classifies an input signal as either voice or data with reduced energy consumption. The present invention includes a frequency estimator and an energy estimator for processing an input signal and a classification unit connected to both the frequency and energy estimators for classifying the input signal. The frequency estimator includes a delay and difference integrator. In operation, the delay receives the input signal and generates a delayed input signal and the difference integrator receives the delayed and input signals and generates a frequency estimate value representing both the estimated central frequency of the input signal and the estimated energy of the input signal. The energy estimator generates an estimate of the energy level of the input signal. The classification unit classifies the input as either voice or data based on a comparison of the frequency and energy estimate values and a data threshold value.

32 Claims, 5 Drawing Sheets

APPARATUS AND METHOD FOR DISCRIMINATING BETWEEN VOICE AND DATA BY USING A FREQUENCY ESTIMATE REPRESENTING BOTH A CENTRAL FREQUENCY AND AN ENERGY OF AN INPUT SIGNAL

FIELD OF THE INVENTION

The present invention relates generally to signal processing in a communication system and more particularly to classifying an input signal as either voice or data.

BACKGROUND OF THE INVENTION

For the most part, telecommunication systems were originally envisioned for voice signal transmission. Following its inception and implementation, however, pronounced changes have occurred in the telecommunication industry. Not only has voice communication via the telecommunication system become prolific through out the world, the presence of preexisting telephone lines has also made the telecommunication system a major media for data signal transmission. For example, many households and businesses in the United States and many foreign countries include telecommunication systems that are used for both the transmission of voice signals via a telephone and data signals via modem technology. As such, today's telecommunication systems not only transmit an increasing number of voice signals, but are also used as a major throughput for data signals.

With the increased use of the telephone communication system for both voice and data signals, systems and methods have been developed to narrow the required bandwidth needed to transmit voice signals, such that more voice and data may be transmitted on existing telephone lines. For example, many of today's telecommunication systems use encoding techniques to encode voice signals for transmission in telecommunication systems. These encoding techniques allow more information to be transmitted within the limited bandwidth of the telecommunication system.

Although encoding of voice signals is advantageous, implementation of voice encoding techniques in telecommunication systems can be somewhat problematic. Specifically, most telephone lines are used for both voice and data transmission. However, encoding techniques used for encoding of voice signals may introduce errors if used to encode data signals. In light of this, voice/data discrimination systems and techniques have been developed to discern voice and data signals, such that voice signals may be encoded, while data signals may be left unaffected or encoded by a different encoding procedure. These voice/data discrimination systems typically analyze signals transmitted on the telecommunication system and classify communication signals as either voice or data. Voice signals are then encoded prior to transmission to increase the amount of voice and data that may be transmitted in the telecommunication system.

Although conventional voice/data discrimination systems provide viable methods for voice and data signal discrimination, they do have some drawbacks. For example, one drawback with conventional voice/data discriminators is that they are typically computational intensive and may require an undesired amount of energy for voice/data discrimination. For example, many conventional voice/data discrimination systems use multipliers, dividers, Fast Fourier Transform systems, neural networks, and many other types of computational schemes to analyze signals transmitted on telecommunication systems and accurately characterize the signals as either voice or data. While these conventional voice/data discrimination systems typically provide a system for accurately characterizing communication signals as either voice or data, the energy consumed in analysis of the communication signals may be unacceptable.

Specifically, many telecommunication systems are comprised of either thousands or millions of communication lines used for transmission of both voice and data signals. A dedicated voice/data discrimination systems is typically needed to discriminate between voice and data for each communication line. Although the energy consumption of each individual voice/discriminator due to computationally intensive analysis of the signals may be negligible, the use of a plurality of these conventional voice/data discriminators in a telecommunication system may consume an unacceptable amount of energy. This may be particularly problematic in systems where energy conservation is at a premium.

An additional problem is that some conventional systems differentiate between voice and data signals based on specific characteristics of the data signals. Specifically, in many telecommunication systems, such as systems that use modems, an initial set of tones may be transmitted across the telecommunication line to inform systems that a data signal, as opposed to a voice signal, is being transmitted. In light of this fact, some conventional voice/data discrimination systems analyze the initial portion of a telecommunication signal and classify the signal as either voice or data based on whether these initial tones are present. While these conventional voice/data discrimination systems typically provide convenient apparatus and methods for discriminating between voice and data signals, they are somewhat limited. Specifically, these conventional voice/data discrimination systems must be activated prior to transmission of the telecommunication signal in order to classify the data as either voice or data.

SUMMARY OF THE INVENTION

As set forth below, the apparatus and method of the present invention may overcome many of the deficiencies identified with discriminating between voice and data signals in a communication system. In particular, the present invention provides apparatus and methods for classifying communication signals as either voice or data with a limited number of computational instructions, (i.e., multipliers, dividers, etc.), such that the communication signals may be classified with reduced energy consumption. Additionally, the present invention, provides apparatus and methods that may discriminate between voice and data signals based on the communication signal, as opposed to specific signal characteristics at the beginning of the signal. As such, the apparatus and methods of the present invention may classify a telecommunication signal as either voice or data without requiring activation prior to beginning transmission of the telecommunication signal.

The present invention provides several embodiments for classifying a communication signal as either voice or data in a communication system. For example, one embodiment of the present invention provides an apparatus and method for classifying an input signal based on both an estimation of the central frequency of an input signal and the energy level of the input signal. The apparatus of this embodiment includes a frequency estimator for generating a frequency estimate value representing both the estimated central frequency of an input signal and the estimate of the energy level of an input signal. The apparatus also includes an energy estimator for generating an energy estimate value representing an estimate of the energy level of the input signal. Additionally, the apparatus of this embodiment includes a classification unit in electrical communication with both the frequency and energy estimators for classifying the input signal as either a voice or data signal.

In operation, both the frequency and energy estimators receive the input signal and generate respective frequency and energy estimate values of the input signal. These estimate signals are received by the classification unit and compared to a data threshold value. If the frequency estimate value is at least as great as the data threshold value, the classification unit classifies the input signal as data. Otherwise, the input signal is classified as a voice signal.

Importantly the apparatus of this embodiment uses both the frequency and energy estimate of the input signal to classify the input signal as either voice or data. Because the present invention uses rough estimates of these values, as opposed to more accurate estimations provided by computational intensive systems, the apparatus and method of the present invention can typically classify the communication signal as either voice or data with less energy consumption. Additionally, because the present invention analyzes the communication signal, as opposed to initial tones appearing at the beginning of the signal, the apparatus and method of the present invention can typically classify the communication signal even if the apparatus and method of the present invention is activated during mid-transmission of the signal.

As discussed above, the present invention classifies the input signal based on both the frequency estimate and the energy estimate value of the input signal. In one embodiment, the present invention classifies the input signal based on an estimate of the central frequency of the input signal. To determine an estimate of the central frequency of the input signal, the classification unit of this embodiment further includes a normalizer in electrical communication with both the frequency and energy estimators. The normalizer generates an estimate of the central frequency of the input signal by comparing the frequency and energy estimate values generated by the frequency and energy estimators. Specifically, the frequency estimator of the present invention generates a composite signal representing both the estimated central frequency of the input signal and the estimated energy level of the input signal. The normalizer of this embodiment, compares the frequency and energy estimate values and generates a normalized frequency estimate value representing an estimate of the central frequency of the input signal.

To analyze the estimated central frequency of the input signal, the classification unit of this embodiment further includes a frequency detector in electrical communication with the normalizer. In this embodiment of the present invention, the frequency detector compares the normalized frequency estimate value generated by the normalizer to a data threshold value representing a threshold frequency value. Input signals having estimated central frequencies value equal to and above the data threshold value are considered data signals. As such, if the frequency estimate value of the input signal is at least as great as the data threshold value, the frequency detector classifies the input signal as data. Otherwise, the frequency detector classifies the input signal as voice.

As discussed, the classification unit of this embodiment includes a normalizer for normalizing the frequency estimate signal. In one embodiment of the present invention, the normalizer comprises a divider in electrical communication with both the frequency and energy estimators. In this embodiment of the present invention, the divider divides the frequency estimate value representing both an estimate of the central frequency of the input signal and the energy level of the input signal by the energy estimate value representing an estimate of the energy level of the input signal. As such, the normalizer generates a normalized frequency estimate value representing an estimate of the central frequency of the input signal.

As an alternative to the use of a normalizer, which may be energy consuming, the apparatus of the present invention may use an energy detector and a look-up table stored in a memory device to normalize the energy estimate signal. Specifically, in this embodiment, the classification unit of the present invention may include an energy detector in electrical communication with both the energy estimator and the frequency detector. Additionally, the classification unit of this embodiment may also include a look-up table stored in a memory device in electrical communication with the energy detector. The look-up table of this embodiment includes a plurality of differing data threshold values, each representing a selected threshold value for a given energy level of the input signal, (i.e., the selected threshold value multiplied by the given energy level).

In this embodiment of the present invention, the energy detector receives the energy estimation value and selects a frequency threshold value from the plurality of differing threshold values in the look-up table. Specifically, the energy detector selects the frequency threshold value corresponding to the energy level of the input signal. This frequency threshold value is supplied to the frequency detector of the classification unit. The frequency detector, in turn, uses the selected frequency threshold value to classify the input signal as either voice or data. Importantly, the classification unit of this embodiment uses a selected frequency from the look-up table to compensate for the energy level of the input signal, as opposed to the use of a normalizer. As such, the apparatus and method of this embodiment can typically classify the input signal with reduced computational instructions and reduced energy consumption due to the elimination of the normalizer.

As discussed above, the present invention typically classifies the input signal as either voice or data based on the estimated frequency value. However, in some embodiments, the present invention may initially evaluate the estimated energy level of the input signal to determine whether the input signal has sufficient energy for classification as a data signal. In this embodiment, if the input signal has an energy level that is less than a predetermined energy threshold value, the input signal is considered to have an insufficient energy level to be a data signal and classifies the input signal as voice, without further evaluating the frequency estimate value.

In this embodiment of the present invention, the classification unit further includes a switch in electrical communication with both the normalizer and the frequency detector for selectively connecting the normalizer and the frequency detector. The apparatus of this embodiment also includes an energy detector in electrical communication with the energy estimator and the switch. In operation, the energy detector initially compares the energy estimate value to an energy threshold value defining a predetermined minimum energy level. If the energy estimate value is less than the energy threshold value, the energy detector classifies the input signal as voice and the frequency estimate value is not further analyzed by the frequency detector. However, if the energy estimate value is at least as great as the energy threshold value, the energy detector controls the switch to connect the normalizer and the frequency detector, such that the frequency detector analyzes the frequency estimate value and classifies the input signal as either voice or data.

As detailed above, the present invention includes a frequency estimator for generating a frequency estimate value representing both the estimated central frequency of the input signal and the estimated energy level of input signal. In one embodiment of the present invention, the frequency estimator generates the frequency estimate value by taking the derivative of the input signal. To take the derivative of the input signal, the frequency estimator of this embodiment includes a delay in electrical communication with the input signal and a difference integrator in electrical communication with both the delay and the input signal. In operation, the delay receives the input signal and generates a delayed input signal. The difference integrator, in turn, receives the delayed, as well as the input signal and generates a frequency estimate value representing both the estimated central frequency of the input signal and the estimated energy of the input signal. This frequency estimate value is used by the classification unit as previously described above to classify the input signal as either voice or data.

In a further embodiment of the present invention, the frequency estimator may also include an absolute value device and an accumulator in electrical communication with the difference integrator. In this embodiment of the present invention, the absolute value device receives the frequency estimate value and generates an absolute value of the frequency estimate value and the accumulator device generates a smoothed or filtered frequency estimate value.

As detailed above, the present invention includes an energy estimator for generating an estimate of the energy level of the input signal. In one embodiment of the present invention, the energy estimator may also include an absolute value device and an accumulator in electrical communication with the input signal. In this embodiment of the present invention, the absolute value device receives input signal and generates an absolute value of the input signal and the accumulator device generates a smoothed or filtered energy estimate value.

As briefly discussed above and detailed in the various embodiments below, the present invention provides apparatus and methods for classifying communication signals as either voice or data with a limited number of computational instructions, (i.e., multipliers, dividers, etc.), such that the telecommunication signals may be typically classified with reduced energy consumption. Additionally, the present invention, provides apparatus and methods that may discriminate between voice and data signals based on the communication signal, as opposed to specific signal characteristics at the beginning of the signal. As such, the apparatus and methods of the present invention may classify a telecommunication signal as either voice or data without the prerequisite of the apparatus and method of the present invention being activated prior to beginning transmission of the communication signal.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
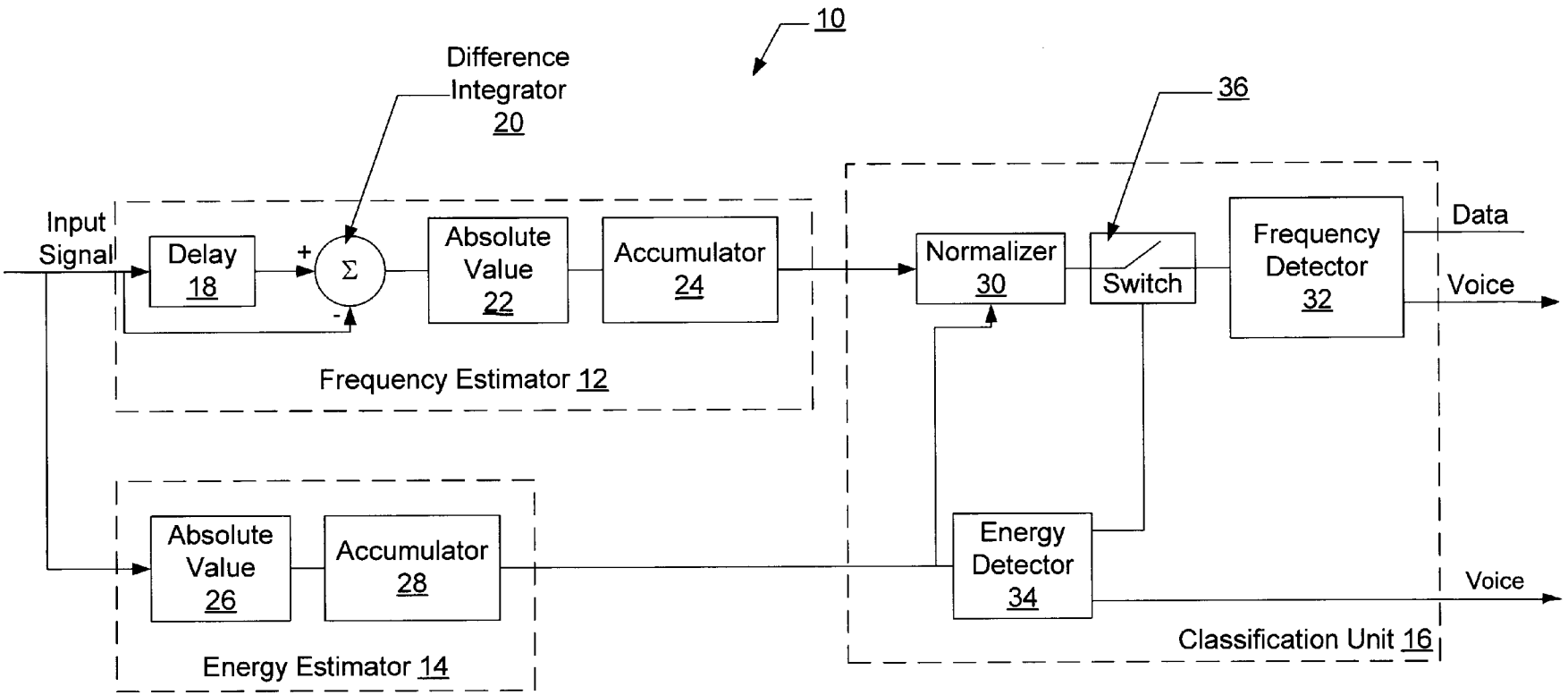
FIG. 1 is a block diagram of an apparatus for classifying an input signal in a communication system as either voice or data according to one embodiment of the present invention.

With reference to FIG. 1, one embodiment of an apparatus for classifying an input signal as either voice or data in a communication system is illustrated. The apparatus 10 of this embodiment includes a frequency estimator 12 for receiving an input-signal transmitted via a communication system. The apparatus of this embodiment also includes an energy estimator 14 that also receives the input signal. Connected to the output of both the frequency and energy estimators is a classification unit 16.

Figure 2:
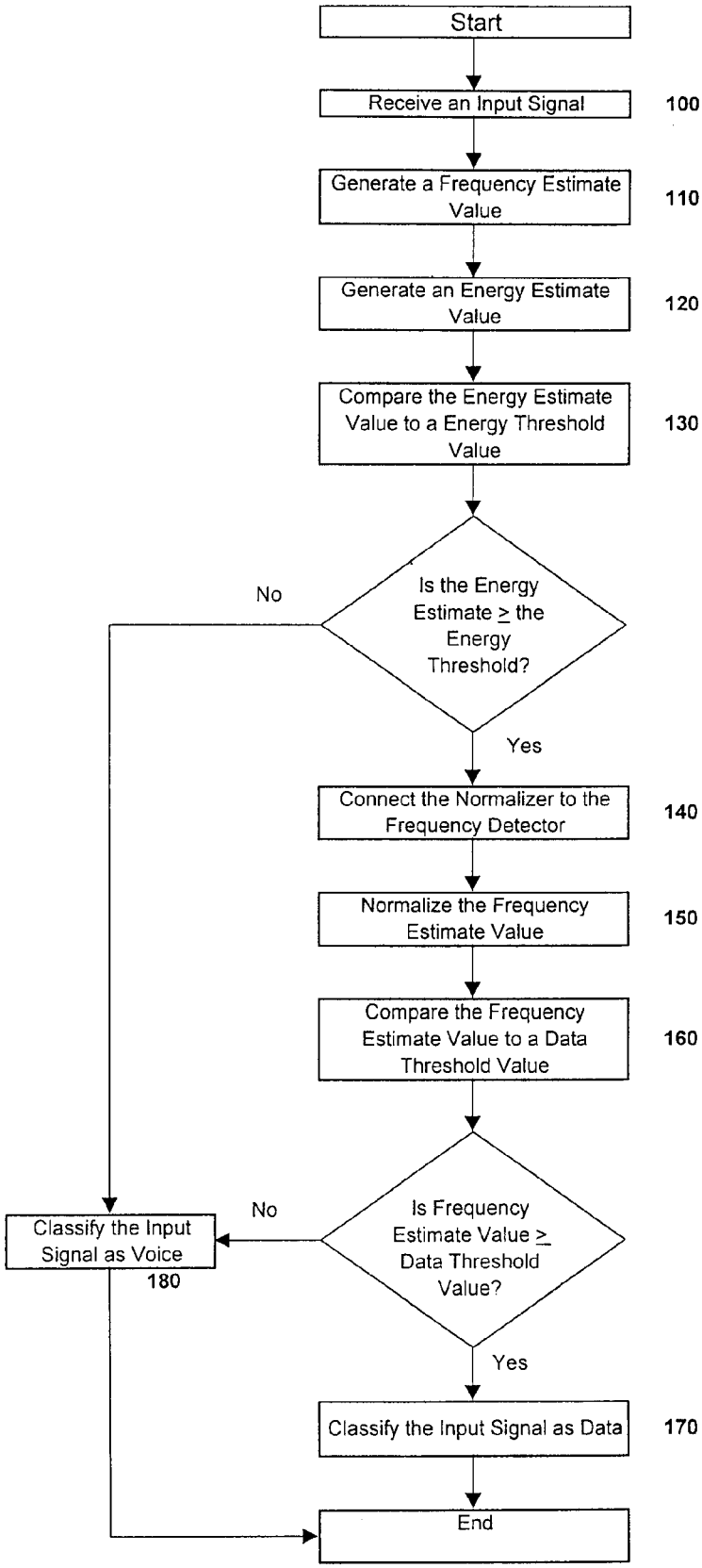
FIG. 2 is a block diagram of the operations performed to classify an input signal in a communication system as either voice or data according to one embodiment of the present invention.

With reference to FIG. 2, in operation, the frequency and energy estimators both receive the input signal. (See step 100). The frequency estimator generates a frequency estimate value representing both an estimate of the central frequency of the input signal and an estimate of the energy level of input signal. (See step 110). Likewise, the energy estimator generates an energy value representing an estimate of the energy level of the input signal. (See step 120). The classification unit receives both the frequency and energy estimate values and compares the values to a data threshold value. (See step 160). Based on this comparison, the classification unit classifies the input signal as either voice or data. (See steps 170 and 180).

As illustrated in FIG. 2, the present invention classifies the input signal as either voice or data based on an estimate of the central frequency of the input signal, an estimate of the energy level of the input signal, and a data threshold value. An important aspect of the present invention, is that the present invention classifies the input signal as either voice or data with reduced energy consumption. Specifically, the apparatus and method of the present invention use either no or few computational instructions, (i.e., multipliers, dividers, etc.), to classify the input signal. Instead, the apparatus and method of the present invention rely on estimated frequency and energy values for the input signal to classify the signal as either voice or data.

Additionally, the present invention, classifies the input signal as either voice or data based on the input signal itself, as opposed to specific signal characteristics at the beginning of the input signal. As such, the apparatus and methods of the present invention may classify a communication signal as either voice or data without requiring activation of the apparatus and method of the present invention prior to beginning transmission of the communication signal.

As discussed, the frequency estimator of the present invention generates a frequency estimate value representing both an estimate of the central frequency of the input signal and an estimate of the energy level of input signal. With reference to FIG. 1, in one embodiment of the present invention, the frequency estimator provides the frequency estimate value with reduced computational instructions. Specifically, in this embodiment of the present invention, the frequency estimator 12 includes a delay 18 in electrical communication with the input signal. Connected to the delay is a difference integrator 20 that is in electrical communication with both the delay and the input signal. Additionally, the frequency estimator of this embodiment includes an absolute value device 22 and an accumulator 24.

Figure 3:
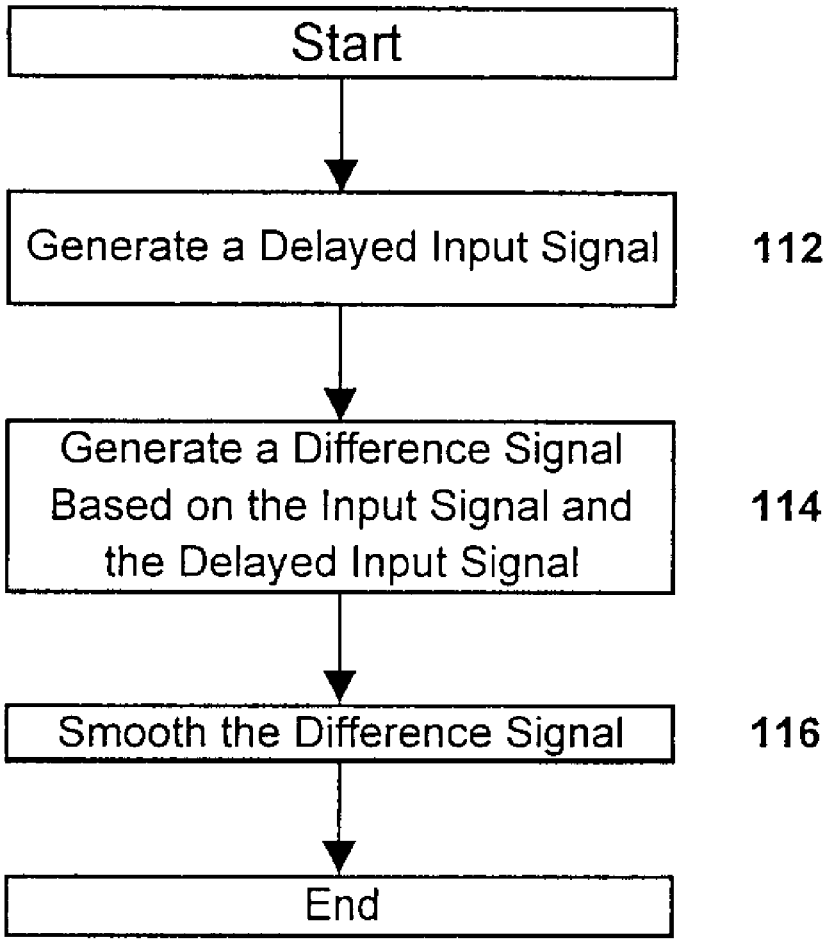
FIG. 3 is a block diagram of the operations performed to estimate the central frequency of an input signal according to one embodiment of the present invention.

With reference to FIG. 3, to generate a frequency estimate value representing both an estimate of the central frequency of the input signal and an estimate of the energy level of input signal, (see step 110), the delay initially receives the input signal and generates a delayed input signal. (See step 112). The delayed input signal and the input signal are both received by the difference integrator. The difference integrator next generates a difference signal representing both an estimate of the central frequency of the input signal and an estimate of the energy level of input signal, (i.e. the frequency estimate value). (See step 114). This difference signal (i.e., frequency estimate value), is received by the absolute value device and accumulator, where it is smoothed or filtered. (See step 116).

As illustrated, the frequency estimator of this embodiment uses a delay and difference integrator to determine the frequency estimate value. In this embodiment, the frequency estimator essentially determines the derivative of the input signal. This derivative defines a composite signal including both an estimate of the central frequency of the input signal and an estimate of the energy level of input signal.

Importantly, the frequency estimator of this embodiment provides an estimate of the central frequency of the input signal with a limited number of computational instructions, (i.e., multipliers, dividers, etc.), such that the input signal may be classified with reduced energy consumption.

With reference to FIG. 1, the apparatus of the present invention also includes an energy estimator 14 for providing an estimate of the energy level of the input signal. Importantly, in one embodiment of the present invention, the energy estimator provides an estimate of the energy level of the input signal with reduced computational instructions. Specifically, in one embodiment of the present invention, the energy estimator also includes an absolute value device 26 and an accumulator 28. In this embodiment of the present invention, the absolute value device receives the input signal and determines the absolute value of the input signal. This absolute value is then supplied to the accumulator which smoothes or filters the signal and generates a value representing the energy level of the input signal. As with the frequency estimator, the energy estimator of this embodiment provides an estimate of the energy level of the input signal with a limited number of computational instructions, (i.e., multipliers, dividers, etc.), such that the input signal may be classified with reduced energy consumption.

As discussed, the frequency estimator generates a frequency estimate value representing both an estimate of the central frequency of the input signal and an estimate of the energy level of the input signal. In one embodiment of the present invention, it may be advantageous to classify the input signal as either voice or data based on the estimate of the central frequency of the input signal. With reference to FIG. 1, in this embodiment of the present invention, the classification unit 16 includes a normalizer 30 in electrical communication with both frequency and energy estimators, 12 and 14, respectively. Additionally, the apparatus of this embodiment may include a frequency detector 32 in electrical communication with the normalizer.

With reference to FIG. 2, to classify the signal as either a voice or data signal based on an estimate of the central frequency of the input signal, the normalizer receives the frequency and energy estimate values from the frequency and energy estimators. The normalizer normalizes the frequency estimate value, which represents both an estimate of the central frequency of the input signal and an estimate of the energy level of input signal, by comparing the frequency estimate value to the energy estimate value, which represents an estimate of the energy level of the input signal. The normalizer generates a normalized frequency estimate signal representing an estimate of the central frequency of the input signal. (See step 150). The frequency detector receives the normalized frequency estimate signal and compares the signal to a data threshold value. (See step 160). In this embodiment of the present invention, the data threshold value represents a predetermined frequency threshold value, below which, an input signal is considered a voice signal. As such, in this embodiment, if the normalized frequency estimate signal is at least as great as the data threshold value, the frequency threshold detector classifies the input signal as a data signal. (See step 170). Otherwise, the input signal is classified a voice signal. (See step 180).

As detailed, the classification unit of this embodiment compares the estimation of the central frequency of the input signal to a data threshold value representing a predetermined threshold value. In this embodiment, the predetermined threshold value defines a frequency value, where input signals having central frequencies equal to or above the selected data threshold value are considered data signals and input signals having central frequencies less than the threshold are considered voice. The data threshold value is a selectable frequency value that may be chosen based on the characteristics of the communication system in which the present invention is implemented. Additionally, the threshold value may be selected based on the type of language (e.g., English, French, Spanish, German, etc.) used in voice communication in the communication system.

Importantly, in some embodiments of the present invention, the frequency value selected for the data threshold value may be selected so as to reduce the risk that a data signal may be incorrectly classified as a voice signal. As earlier discussed, if encoding techniques designed for encoding voice signals are used on data signals, errors may be introduced into the data signal. For this reason, the frequency threshold value may be selected so as to reduce the probability that a data signal will be incorrectly characterized as a voice signal and encoded. Specifically, the data threshold value may be chosen such that even though some of the voice signals may be characterized incorrectly as data signals and not encoded, that only a negligible number of data signals will be characterized incorrectly as voice and encoded.

In one embodiment, the data threshold value is chosen based on the premise that data is usually evenly spread across the frequency spectrum, while voice is typically located in the bottom portion of the spectrum. For example, in one embodiment of the present invention, the data threshold value may be selected as 1000 Hz. In this embodiment, input signals having estimated central frequencies at least as great as 1000 Hz are considered data signals and input signals having an estimated central frequency below 1000 Hz are considered voice signals. The data threshold value is chosen such that even though some the voice signals may be characterized incorrectly as data signals and not encoded, there is a decreased likelihood that data signals will be characterized incorrectly as voice and encoded.

In addition to analyzing the estimated central frequency of the input signal, in some embodiments, the estimated energy level of the input signal may also be used to classify the input signal as either voice or data. Specifically, in some embodiments of the present invention, the estimated energy level of the input may be initially evaluated to determine whether the input signal has sufficient energy to contain data. If the input signal has a relatively small energy level, the input signal is considered to have too low an energy level to contain data and is classified as a voice signal.

With reference to FIG. 1, in this embodiment, the classification unit 16 further includes an energy detector 34 in electrical communication with the energy estimator 14. The classification unit of this embodiment also includes a switch 36 in electrical communication with the normalizer 30, frequency detector 32, and the energy detector 34. Importantly, the switch is configured to selectively connect the normalizer to the frequency detector.

With reference to FIG. 2, in this embodiment, both the frequency and energy estimators receive the input signal, and generate frequency estimate and energy estimate values, respectively. (See steps 100–120). The energy detector of this embodiment, receives the energy estimate value and compares the energy estimate value to an energy threshold value. (See step 130). If the energy estimate value is at least as great as the energy threshold value, the energy detector controls the switch to connect the normalizer to the frequency threshold detector, (see step 140), such that the input signal may be further analyzed based on the estimate of the central frequency of the signal to determine if it is voice or data. (See steps 150–170). However, if the energy estimate value is less than the energy threshold value, the energy detector classifies the input signal as voice. (See step 180).

As discussed, the energy detector of this embodiment compares the energy estimate value of the input signal to an energy threshold value to determine whether the input signal has sufficient energy. The energy threshold value is a selectable value that may be chosen based on any desired criteria. In some embodiments, the energy threshold value is chosen based on the characteristics of the communication system.

As an example, in one embodiment, the energy threshold value is selected as one fourth of the total dynamic range of the energy detector. In this embodiment, the energy detector may provide an output that is based on the energy of the input signal. For instance, the energy detector may have a range of 0 to 255 counts. In this embodiment, one fourth of the 255 is approximately 64 counts. As such, if the input signal has an energy level that is at least as great as 64 counts, the energy detector controls the switch to connect the normalizer to the frequency threshold detector, (see step 140), such that the input signal may be further analyzed based on the estimate of the central frequency of the signal to determine if it is voice or data. (See steps 150–170). However, if the energy estimate value is less than 64 counts, the energy detector classifies the input signal as voice. (See step 180).

FIG. 1 illustrates an embodiment of the present invention in which the classification unit includes a normalizer that normalizes the estimated frequency value based on the energy estimate value. Although this embodiment is advantageous for most applications, in some embodiments, due to energy constraints, the normalizer may consume an unsatisfactory amount of energy. Specifically, the normalizer performs a computational instruction, such as a multiply or divide to separate the estimate of the central frequency of the input signal from the estimate of the energy of input signal, that may consume energy. To alleviate the energy consumed by a normalizer, the present invention provides embodiments in which the normalizer of the classification unit can be eliminated.

Figure 4:
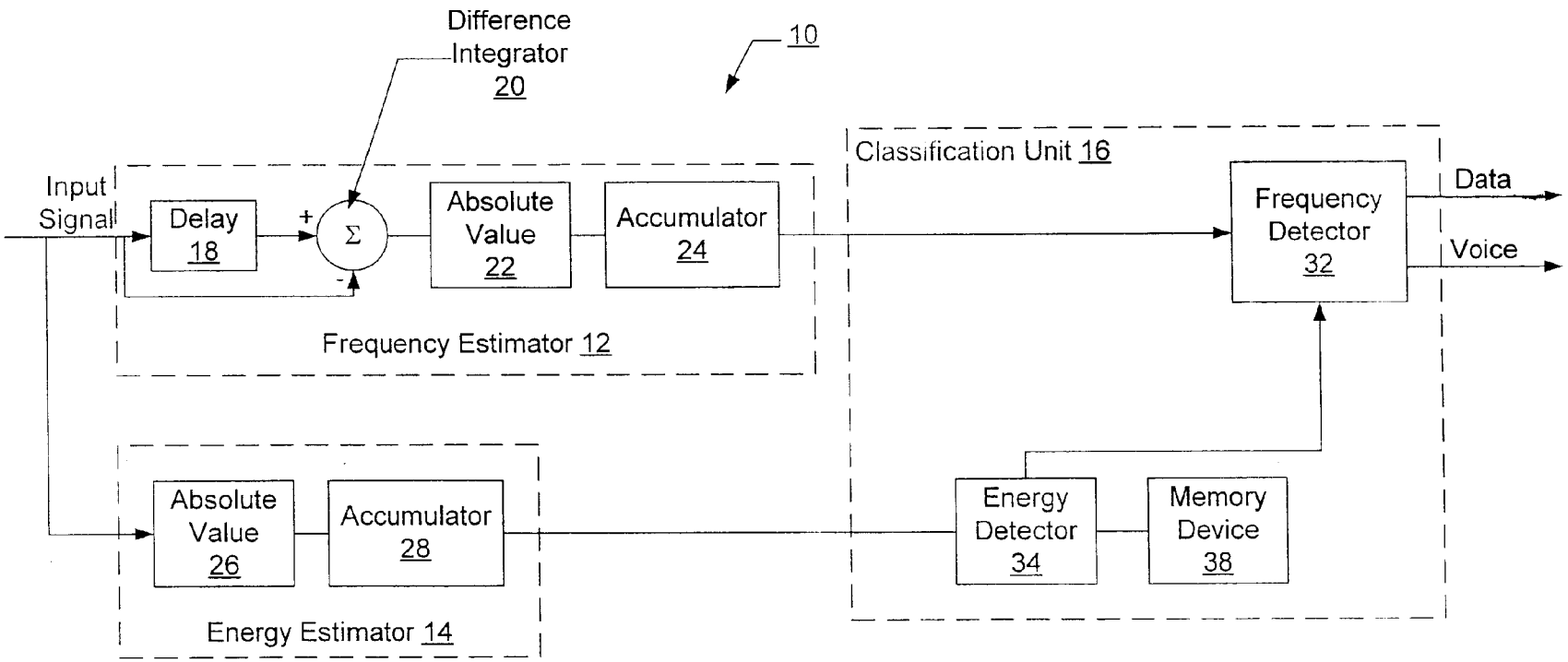
FIG. 4 is a block diagram of an apparatus for classifying an input signal in a communication system as either voice or data using a look-up table containing a plurality of data threshold values according to one embodiment of the present invention.

Specifically, with reference to FIG. 4, another embodiment for classifying an input signal as either voice or data in a communication system is shown. The apparatus of this embodiment comprises frequency and energy estimators, 12 and 14, respectively, as illustrated in the previous embodiments. The apparatus of this embodiment also includes a classification unit 16 having a frequency detector 32 in electrical communication with the frequency estimator and an energy detector 34 in electrical communication with both the energy estimator 14 and the frequency detector 32.

Importantly, the classification unit of this embodiment also includes a memory device 38 in electrical communication with the energy detector 34. The memory device includes a look-up table including a plurality of data threshold values. Each of the data threshold values in the table define the predetermined frequency threshold value multiplied by different possible energy levels of the input signal. Specifically, as discussed previously, the frequency estimator 12 outputs a frequency estimate value representing both an estimate of the central frequency of the input signal and an estimate of the energy level of the input signal. Instead of separating the estimate of the central frequency from the estimate of the energy level of the input signal by use of a normalizer, the look-up table includes a data threshold value for each possible energy level of the input signal. The value of each data threshold value in the look-up table is chosen to compensate for the energy level portion of the input signal. In other words, each data threshold value of the look-up table for each energy level $T_i$ is equal to the energy level $E_i$ multiplied by the predetermined frequency value chosen for the data threshold $T_0$, i.e.,:

$$T_i = E_i \times T_0$$

where $T_i$=threshold value for the energy level, $E_i$=energy level, and $T_0$=predetermined frequency value of the data threshold.

Because each the plurality of frequency threshold values compensates for the energy level of the input signal, a normalizer is not required to normalize the frequency estimate value. As such, the energy normally consumed by the normalizer may be conserved.

Figure 5:
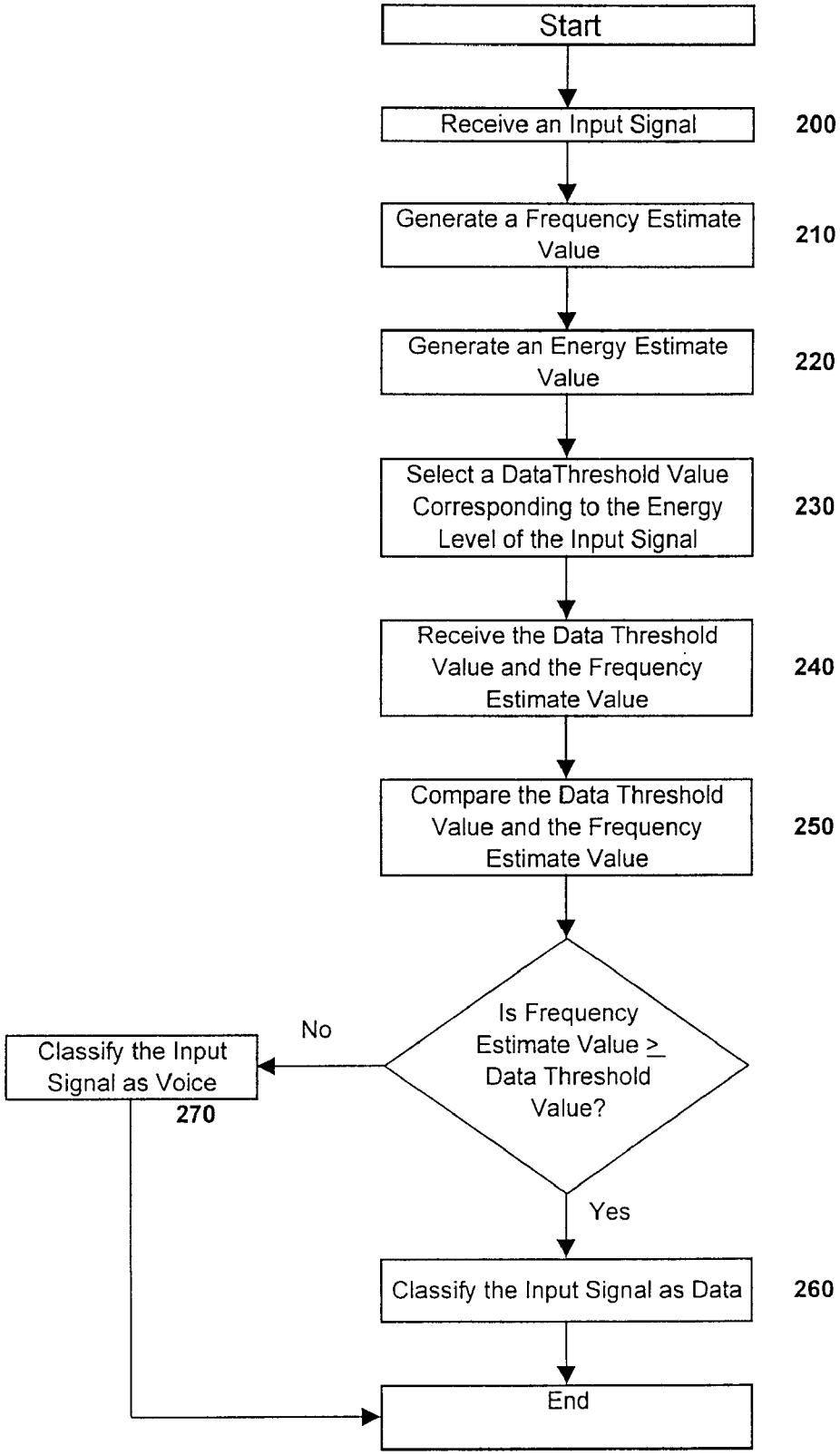
FIG. 5 is a block diagram of the operations performed to classify an input signal in a communication system as either voice or data using a look-up table containing a plurality of data threshold values according to one embodiment of the present invention.

With reference to FIG. 5, in this embodiment of the present invention, both the frequency and energy estimators receive the input signal, and generate frequency estimate and energy estimate values, respectively. (See steps 200–220). The energy detector of this embodiment, receives the energy estimate value and selects from the look-up table the data threshold value corresponding to the energy level of the input signal. (See step 230). The data threshold value is then supplied to the frequency detector. The frequency detector receives the energy estimate value representing both the estimated central frequency of the input signal and the estimated energy level of input signal from the frequency estimator and the data threshold value from the frequency detector. (See step 240). The frequency detector compares the estimate frequency value to the selected data threshold value, (see step 250), and if the frequency estimate value is at least as great as the selected data threshold, the frequency detector classifies the input signal as data. (See step 260). Otherwise, the frequency detector classifies the input signal as voice. (See step 270).

As discussed, the look-up table of the present embodiment includes a data threshold value corresponding to each of the possible energy levels of the input signal. It must be understood that in some instances, the look-up table may include data threshold values for incremental values of the energy of the input signal. In this embodiment, the energy estimate value may be compared to the values in the look-up table, and the data threshold value determined using interpolation. In another embodiment of the present invention, the look-up table may include frequency threshold values for each factor of two of the energy level of the input signal. In this embodiment of the present invention, the energy estimate value may be rounded to the nearest factor of two, and a data threshold value selected corresponding to the rounded value.

As detailed above, in some embodiments, both the frequency and energy detectors include absolute value devices and accumulators. It must be understood that these devices may be any type of device suited for smoothing the signals. For example, in one embodiment of the present invention the absolute value and accumulator are embodied in a low pass filter.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for classifying an input signal as either a voice or data signal in a communication system, wherein said apparatus comprises:

a frequency estimator that receives the input signal and generates a frequency estimate value representing both an estimated central frequency of the input signal and an estimated energy level of input signal;

an energy estimator that receives the input signal and generates an energy estimate value representing an estimate of the energy level of the input signal; and a classification unit in electrical communication with both said frequency and energy estimators, wherein said classification unit receives the frequency and energy estimate values and classifies the input signal as either a voice or data signal based on the frequency and energy estimate values and a data threshold value.

2. An apparatus according to claim 1, wherein said classification unit further comprises a normalizer in electrical communication with both said frequency and energy estimators, and wherein said normalizer generates a normalized frequency estimate value representing an estimate of the central frequency of the input signal.

3. An apparatus according to claim 2, wherein said normalizer divides the frequency estimate value by the energy estimate value and generates a normalized frequency estimate value representing an estimate of the central frequency of the input signal.

4. An apparatus according to claim 2, wherein the data threshold value defines a frequency value, wherein said classification unit further comprises a frequency detector in electrical communication with said normalizer, and wherein said frequency detector compares the normalized frequency estimate value to the data threshold value and classifies the input signal as a data signal if the normalized frequency estimate value is at least as great as the data threshold value.

5. An apparatus according to claim 2, wherein said classification unit further comprises:

a frequency detector in electrical communication with said normalizer;

a switch in electrical communication with both said normalizer and said frequency detector for selectively connecting the normalizer and the frequency detector; and an energy detector in electrical communication with said energy estimator and said switch, wherein said energy detector initially compares the energy estimate value to an energy threshold value defining a minimum energy level, wherein if the energy estimate value is at least as great as the energy threshold value, said energy detector controls said switch to connect said normalizer and said frequency detector, such that the frequency detector may classify the input signal as either voice or data.

6. An apparatus according to claim 1, wherein said classification unit further comprises an energy detector in electrical communication with said energy estimator, wherein said energy detector initially compares the energy estimate value to an energy threshold value defining a minimum energy level, and wherein said energy detector classifies the input signal as a voice signal if the energy estimate value is no greater than the energy threshold value.

7. An apparatus according to claim 1, wherein said classification unit comprises:

a frequency detector in electrical communication with said frequency estimator;

an energy detector in electrical communication with both said energy estimator and said frequency detector; and a memory device in electrical communication with said energy detector, said memory device storing a table that includes a plurality of differing data threshold values, wherein said energy detector receives the energy estimate value and selects a data threshold value from the plurality of differing threshold values in said table based on the amplitude of the energy estimation value, and wherein said frequency detector receives the data threshold value from said energy detector and classifies the input signal as a data signal if the frequency estimate value is at least as great as the selected data threshold value.

8. An apparatus according to claim 1, wherein said frequency estimator comprises:

a delay that receives the input signal and generates a delayed input signal;

a difference integrator in electrical communication with said delay and the input signal, wherein said difference integrator receives the delayed and input signals and generates a frequency estimate value representing both the estimated central frequency of the input signal and the estimated energy of the input signal.

9. An apparatus according to claim 8, wherein said frequency estimator further comprises an absolute value device in electrical communication with said delay, wherein said absolute value device receives the frequency estimate value and generates an absolute value of the frequency estimate value.

10. An apparatus according to claim 8, wherein said frequency estimator further comprises an accumulator device in electrical communication with said delay, wherein said accumulator device receives the frequency estimate value and generates a frequency estimate value.

11. An apparatus according to claim 1, wherein said energy estimator comprises:

an absolute value device that receives the input signal and generates an absolute value of the input signal; and an accumulator device in electrical communication with said absolute value device, wherein said accumulator device generates an energy estimate value representing the amplitude of the input signal.

12. A method for classifying an input signal as either a voice or data signal in a communication system, wherein said method comprises the steps of:

receiving an input signal;

generating a frequency estimate value representing both an estimated central frequency of the input signal and an estimated energy of the input signal;

generating an energy estimate value representing an estimate of the energy level of the input signal; and classifying the input signal as either a voice or data signal based on the frequency and energy estimate values and a data threshold value.

13. A method according to claim 12, wherein said classifying step further comprises the step of initially normalizing the frequency estimate value based on the energy estimate value to thereby generate a normalized frequency estimate value representing an estimate of the central frequency of the input signal.

14. A method according to claim 13, wherein said normalizing step comprises dividing the frequency estimate value by the energy estimate value to thereby generate a normalized frequency estimate value representing an estimate of the central frequency of the input signal.

15. A method according to claim 13, wherein the data threshold value defines a frequency value, wherein said classifying step comprises the steps of:

comparing the normalized frequency estimate value to the data threshold value; and classifying the input signal as a data signal if the normalized frequency estimate value is at least as great as the data threshold value.

16. A method according to claim 13, wherein said classifying step further comprises initially comparing the energy estimate value to an energy threshold value defining a minimum energy level, wherein if the energy estimate value is at least as great as the energy threshold value, said classifying step comprises comparing the normalized frequency estimate value to the data threshold value, and classifying the input signal as a data signal if the normalized frequency estimate value is at least as great as the data threshold value.

17. A method according to claim 12, wherein said classifying step further comprises initially comparing the energy estimate value to an energy threshold value defining a minimum energy level, and wherein said classifying step classifies the input signal as a voice signal if the energy estimate value is no greater than the energy threshold value.

18. A method according to claim 12, wherein said classifying step comprises the steps of:

receiving the energy estimate value;

selecting a data threshold value from a plurality of differing threshold values based on the amplitude of the energy estimate value; and classifying the input signal as a data signal if the frequency estimate value is at least as great as the selected data threshold value.

19. A method according to claim 12, wherein said generating a frequency estimate value step comprises the steps of:

delaying the input signal to thereby generate a delayed input signal;

determining a difference between the delayed input signal and the input signal; and generating a frequency estimate value representing both the estimated central frequency of the input signal and the estimated energy of the input signal.

20. A method according to claim 19, wherein said generating a frequency estimate value step further comprises the step of generating an absolute value of the frequency estimate value.

21. A method according to claim 19, wherein said generating a frequency estimate value step further comprises the step of accumulating the frequency estimate value.

22. A method according to claim 12, wherein said generating an energy estimate value step comprises the steps of:

generating an absolute value of the input signal; and generating an energy estimate value representing the amplitude of the input signal.

23. An apparatus for classifying an input signal as either a voice or data signal in a communication system, wherein said apparatus comprises:

a delay that receives the input signal and generates a delayed input signal;

a difference integrator in electrical communication with said delay and the input signal, wherein said difference integrator receives the delayed and input signals and generates a frequency estimate value representing both the estimated central frequency of the input signal and the estimated energy of the input signal; and a classification unit in electrical communication with said difference integrator, wherein said classification unit classifies the input signal as either a voice or data signal based on the frequency estimate value and a data threshold value.

24. An apparatus according to claim 23, wherein said classification unit comprises a normalizer in electrical communication with said difference integrator, wherein said normalizer normalizes the frequency estimate value based on an energy estimate value representing the energy of the input signal and generates a normalized frequency estimate value representing an estimate of the central frequency of the input signal.

25. An apparatus according to claim 24, wherein said normalizer divides the frequency estimate value by the energy estimate value and generates a normalized frequency estimate value representing an estimate of the central frequency of the input signal.

26. An apparatus according to claim 24, wherein said classification unit further comprises a frequency detector in electrical communication with said normalizer, wherein said frequency detector compares the frequency estimate value with a data threshold value, and wherein said detector classifies the input signal as a data signal if the frequency estimate value is at least as great as the data threshold value.

27. An apparatus according to claim 23 further comprising:

an absolute value device in electrical communication with said difference integrator, wherein said absolute value device generates an absolute value of the input signal; and an accumulator device in electrical communication with said absolute value device, wherein said accumulator device generates a frequency estimate value representing both the estimated central frequency of the input signal and the estimated energy of input signal.

28. A method for classifying an input signal as either a voice or data signal in a communication system, wherein said method comprises the steps of:

delaying the input signal to thereby generate a delayed input signal;

generating a frequency estimate value representing both the estimated central frequency of the input signal and the estimated energy of the input signal based upon the input signal and the delayed input signal; and classifying the input signal as either a voice or data signal based on the frequency estimate value and a data threshold value.

29. A method according to claim 28 further comprising after said generating step normalizing the frequency estimate value based on an energy estimate value representing the energy of the input signal to thereby generate a normalized frequency estimate value representing an estimate of the central frequency of the input signal.

30. A method according to claim 29, wherein said normalizing step comprises dividing the frequency estimate value by the energy estimate value to thereby generate a normalized frequency estimate value representing an estimate of the central frequency of the input signal.

31. A method according to claim 29, wherein said classifying step comprises comparing the frequency estimate value with a data threshold value and classifying the input signal as a data signal if the frequency estimate value is at least as great as the data threshold value.

32. A method according to claim 28 further comprising after said generating step:

generating an absolute value of the input signal; and generating a frequency estimate value representing both the estimated central frequency of the input signal and the estimated energy of input signal.

* * * * *